US011214398B2

(12) United States Patent
Spaccarelli

(10) Patent No.: US 11,214,398 B2
(45) Date of Patent: Jan. 4, 2022

(54) BOTTLE LINER

(71) Applicant: John Spaccarelli, Carmel, NY (US)

(72) Inventor: John Spaccarelli, Carmel, NY (US)

( * ) Notice: Subject to any disclaimer, the term of this patent is extended or adjusted under 35 U.S.C. 154(b) by 40 days.

(21) Appl. No.: 16/737,351

(22) Filed: Jan. 8, 2020

(65) Prior Publication Data

US 2020/0216212 A1 Jul. 9, 2020

Related U.S. Application Data

(60) Provisional application No. 62/789,869, filed on Jan. 8, 2019.

(51) Int. Cl.
*B65D 1/02* (2006.01)

(52) U.S. Cl.
CPC ..... *B65D 1/0215* (2013.01)

(58) Field of Classification Search
CPC ..... B65D 1/0215; B65D 35/14; B65D 25/16; B65D 23/02; A61J 9/001
See application file for complete search history.

(56) References Cited

U.S. PATENT DOCUMENTS

2010/0193460 A1* 8/2010 Driver ..... A61J 11/0035 215/11.3
2015/0291309 A1* 10/2015 McGregor ..... A47J 33/00 220/573.1

* cited by examiner

*Primary Examiner* — Andrew T Kirsch
(74) *Attorney, Agent, or Firm* — Leason Ellis LLP

(57) ABSTRACT

A flexible liner is provided for insertion into and containment within a bottle that has a neck portion with an upper edge. The flexible liner has a flexible hollow body formed of silicone, wherein the flexible hollow body has a neck portion that terminated in a lip at a top edge of the flexible hollow body for placement above the upper edge of the bottle.

18 Claims, 5 Drawing Sheets

BOTTLE LINER

CROSS-REFERENCE TO RELATED APPLICATION

The present application claims priority to and the benefit of U.S. provisional patent application Ser. No. 62/789,869, filed Jan. 8, 2019, which is hereby expressly incorporated by reference in its entirety.

TECHNICAL FIELD

The present invention is directed to bottles and receptables and more particularly, to a reusable, washable liner for insertion in the bottle.

BACKGROUND

Bottled water has become an immense industry; however, plastic bottles also have a negative impact on the environment given plastic does not readily degrade. It is therefore desirable to be able to reuse such plastic bottles; however, the inside of the bottles can be fouled over time.

SUMMARY

A flexible liner is provided for insertion into and containment within a bottle that has a neck portion with an upper edge. The flexible liner has a flexible hollow body formed of silicone, wherein the flexible hollow body has a neck portion that terminated in a lip at a top edge of the flexible hollow body for placement above the upper edge of the bottle.

BRIEF DESCRIPTION OF THE DRAWING FIGURES

DETAILED DESCRIPTION OF CERTAIN EMBODIMENTS

Figure 2:
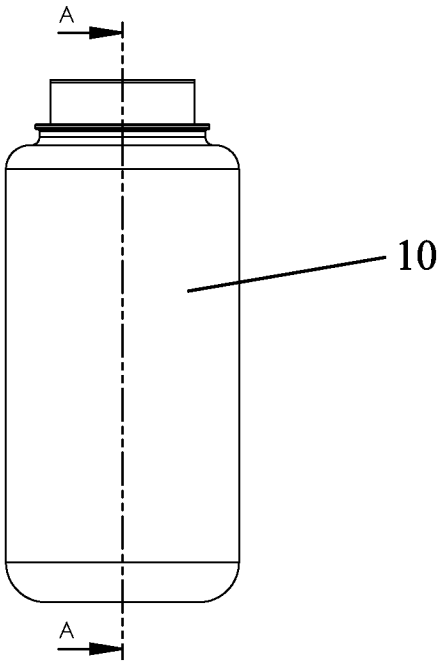
FIG. 2 is a side elevation thereof.
Figure 1:
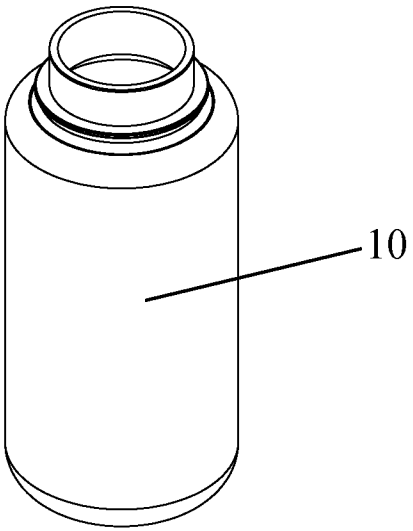
FIG. 1 is a top and side perspective view of a bottle with an inner liner in accordance with a first embodiment.
Figures 3, 4, 5:
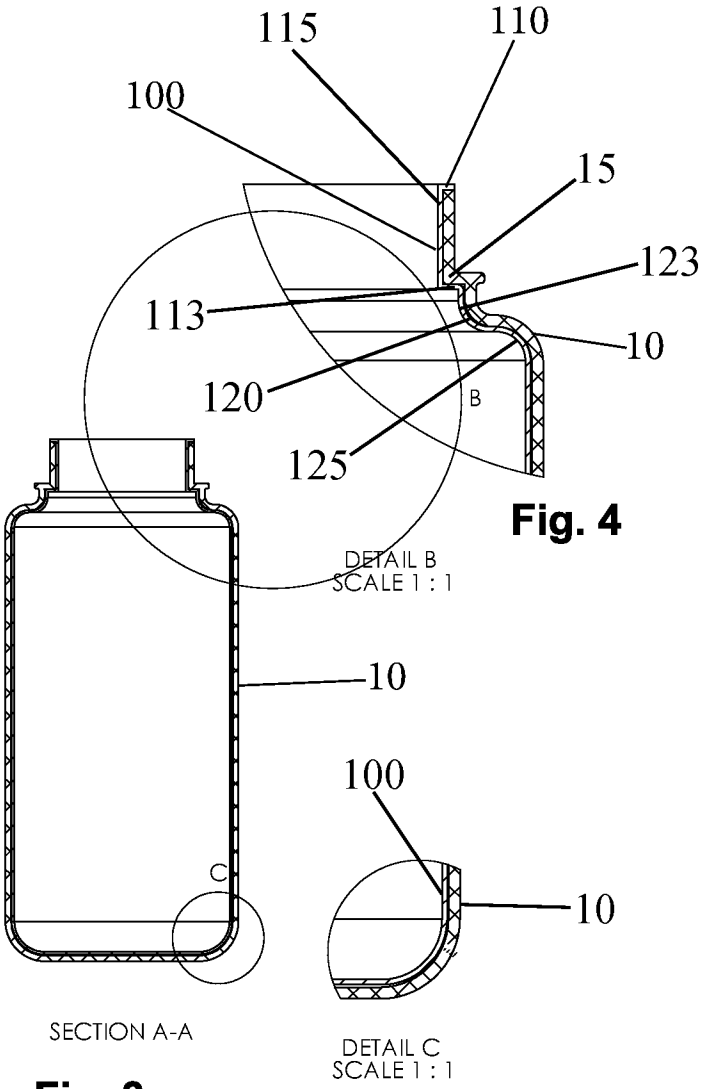
FIG. 3 is a cross-sectional view taken along the line A-A.
FIG. 4 is a close-up of a first portion of the liner.
FIG. 5 is a close-up of a second portion of the liner.
Figure 7:
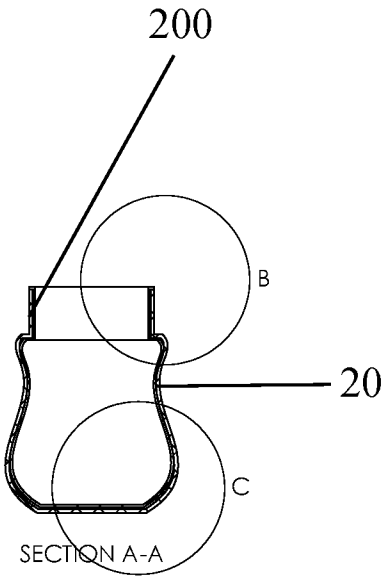
FIG. 7 is a cross-sectional view taken along the line A-A.
Figure 6:
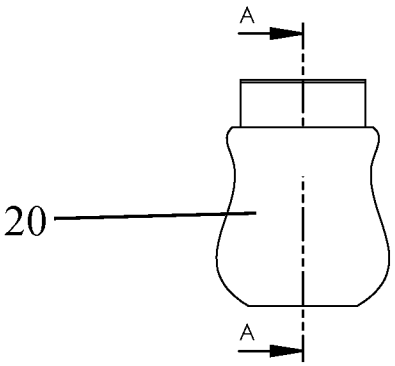
FIG. 6 is a side-elevation view of a bottle and liner in accordance with a second embodiment.
Figure 9:
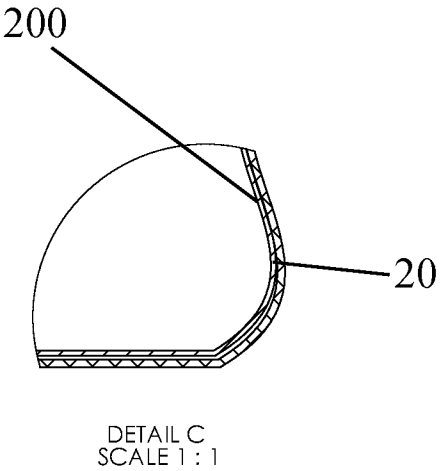
FIG. 9 is a close-up of a second portion of the liner.
Figure 8:
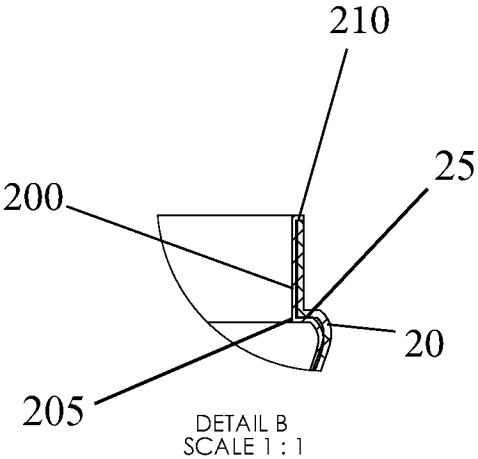
FIG. 8 is a close-up of a first portion of the liner.

The present invention relates to liners for bottles and more particularly, relates to silicone liners that are configured to be first received within different types of bottles and then subsequently receive and hold a liquid. One of the great difficulties of using a resusable bottle is cleaning thereof. Most bottles have curved surfaces and shoulders and these areas make it difficult to clean due to reduced access to these areas and the inflexibility of the cleaning tool.

FIGS. 1-5 illustrate a silicone liner 100 for use with a first bottle 10. Bottle 10 can be in the form of a resusable water bottle. The silicone liner 100 has a complementary shape to mate with the bottle 10 such that the silicone liner 100 nests within the bottle 10. The silicone liner 100 is freely flexible and assumes the form of the surrounding structure, in this case the bottle 10. A top edge of the liner 100 has an annular flange or lip 110 that seats against and on top of the top edge of the bottle 10.

The liner 100 also generally has a neck portion 120 that seats against the neck of the bottle 10. The illustrated neck portion 120 has a first step 113 that seats against a step 15 of the bottle 10. Radially inward from the first step 113, the liner has a top portion 115.

As shown, the neck portion 120 can be S-shaped with the S-shaped portion being located between the first step 113 and the annular wall 119 of the liner 100 that defines the main bottom portion of the liner 100. The top portion 115 and annular wall 119 are parallel to one another. The S-shaped portion can be defined by a first section 123 and a second section 125. The first section 123 is curved in one direction and the second section 125 is curved in the opposite direction with an inflection point formed between.

The bottom of the liner 100 can be curved as shown.

The silicone liner 100 is of food grade, is dishwasher safe and reusable.

The way the liner 100 remains in place is that the top of the liner 100 (i.e., the lip 110) sits on the rim (top edge) of the bottle 10. The bottle 10 is closed with a screw cap top that includes a rubber washer or gasket—this will prevent any kinds of leaks. Thus, the liner 100 can be used with any number of bottles. By placing the lip 110 over the top edge of the bottle 10, the screwing of the cap onto the bottle is not impacted and a seal forms as in a conventional bottle.

FIGS. 6-9 illustrate a silicone liner 200 for use with a second bottle 20 (e.g., baby bottle). The silicone liner 200 sits in the bottle 20 and takes the form (shape) of the bottle 20. As with the previous embodiment, a flange or lip 210 of the liner 200 seats against and on top of the top edge of the bottle 20, thereby allowing the bottle cap to close without interference from the liner 200. The bottom portion of the liner 200 can be curved as shown.

The liner 200 includes a neck portion that has a seat or shoulder 205 that seats against a complementary shoulder or seat 25 of the bottle 20. Between the lip 210 and the seat 205, the liner 200 can have an annular portion that extends vertically.

Figures 10, 11, 12:
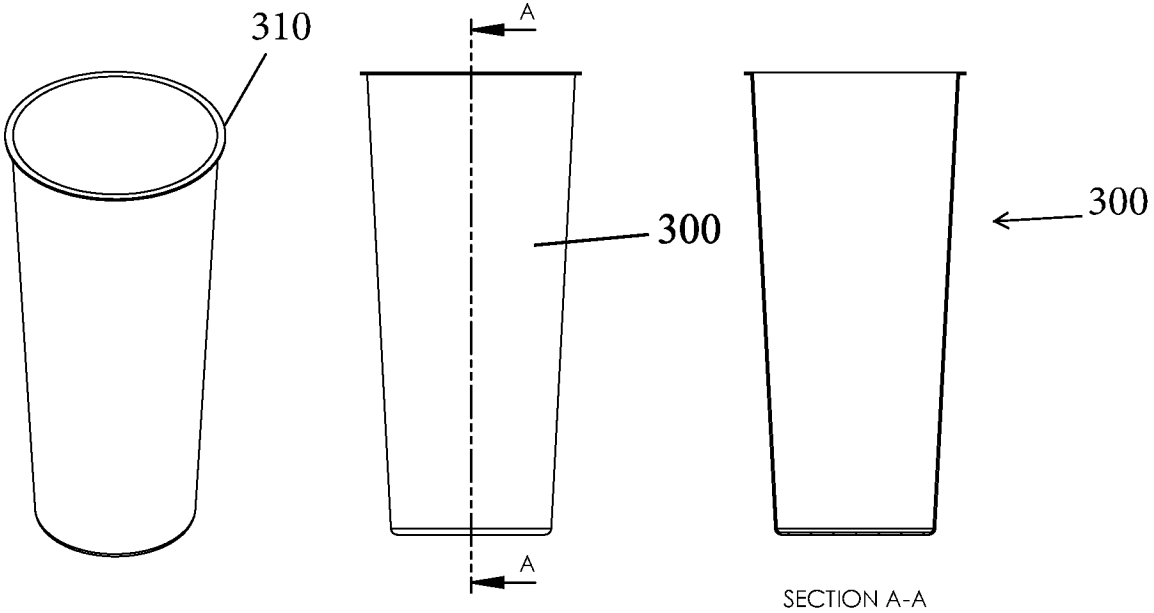
FIG. 10 is a top and side perspective of a liner in accordance with a third embodiment.
FIG. 11 is a side elevation view thereof.
FIG. 12 is a cross-sectional view taken along the line A-A.

FIGS. 10-12 illustrate a silicone liner 300 for use with a third bottle (e.g., blender bottle). The silicone liner 300 sits in the bottle and takes the form (shape) of the bottle. As with the previous embodiment, a flange or lip 310 of the liner 300 seats against and on top of the top edge of the bottle, thereby allowing the bottle cap to close without interference from the liner 300.

The liners disclosed herein provide a liquid containing structure that can be easily removed and cleaned. This allows a user to reuse a bottle with increased peace of mind that the structure holding the liquid is sanitary. The liners thus do not suffer from the cleaning deficiencies noted herein with respect to the bottle construction since they are flexible and can be fully removed from the bottle and manipulated to allow for localized slot cleaning where needed.

By being formed of silicone, the liners described herein are freely flexible but maintain their form in a rest condition/state. They also can be freely inverted to allow for cleaning, etc. The liner is machine washable in that it can be repeatedly placed in a dish washer or the like for cleaning thereof.

What is claimed is:

1. A container system for a holding a drinkable liquid comprising:

a bottle that has a bottom wall, a side wall and a first neck portion with an upper edge; and a flexible, machine washable, reusable liner inserted into and contained within a hollow interior of the bottle, the flexible reusable liner has a flexible hollow body formed of silicone, wherein the flexible hollow body has a second neck portion that terminates in a lip at a top edge of the flexible hollow body for placement above and against the upper edge of the bottle, wherein the flexible hollow body has a main portion below the second neck portion and the second neck portion includes a first step formed along the neck portion that seats flush against a flat second step that is formed in the first neck portion of the bottle, the first step being disposed below the lip, the flexible hollow body being defined by a bottle wall and a side wall that joins to the bottom wall, the flexible hollow body being configured such that when the flexible reusable liner is inserted into the hollow interior of the body, the side wall of the flexible hollow body seats flush against the side wall of the bottle.

2. The container system of claim 1, wherein the bottle has a first neck portion that terminates in the upper edge and the flexible hollow body has a second neck portion that terminates in the lip.

3. The container system of claim 2, wherein the liner is machine washable.

4. The container system of claim 2, wherein the flexible hollow body can be inverted.

5. The container system of claim 2, wherein the first neck portion includes a flat annular shaped flange that faces downward towards the bottom wall of the bottle, the second neck portion having a step portion that seats flush against the flat angular shaped flange of the first neck portion of the bottle.

6. The container system of claim 1, wherein the flexible hollow body has a main portion below the second neck portion and the second neck portion includes a step formed along the second neck portion, the step being disposed below the lip.

7. The container system of claim 6, wherein the main portion is defined by a first annular wall and the second neck portion includes an S-shaped portion that is formed between the step and the first annular wall.

8. The container system of claim 7, wherein the first annular wall and an upper second annular wall of the second neck portion that terminates in the lip are parallel to one another.

9. The container system of claim 8, wherein the lip is formed at a 90 degree angle relative to the upper second annular wall.

10. The container system of claim 6, wherein the step comprises a 90 degree step.

11. The container system of claim 1, wherein the main portion is defined by a first annular wall and the second neck portion includes an S-shaped portion that is formed between the first step and the first annular wall.

12. The container system of claim 11, wherein each of the first step and the second step comprises a 90 degree step.

13. The container system of claim 11, wherein the first annular wall and an upper second annular wall of the second neck portion that terminates in the lip are parallel to one another.

14. The container system of claim 13, wherein the lip is formed at a 90 degree angle relative to the upper second annular wall.

15. The container system of claim 1, wherein the bottle comprises a plastic bottle.

16. The container system of claim 1, wherein a bottom wall of the flexible hollow body seats flush against the bottom wall of the bottle.

17. The container system of claim 1, wherein the lip completely covers the upper edge of the bottle.

18. A container system for a holding a drinkable liquid comprising:

a bottle that has a bottom wall, a side wall and a first neck portion with an upper edge; and a flexible, machine washable, reusable liner inserted into and contained within a hollow interior of the bottle, the flexible reusable liner has a flexible hollow body formed of silicone, wherein the flexible hollow body has a second neck portion that terminates in an upper lip at a top edge of the flexible hollow body, the upper lip being placed above and against the upper edge of the bottle such that the upper lip covers the upper edge of the bottle, wherein the flexible hollow body has a main portion below the second neck portion and the second neck portion includes a first planar step formed along the second neck portion that seats flush against a second planar step that is formed in the first neck portion of the bottle with the first planar step being immediately below and in direct contact with the second planar step when the bottle is upright, the first step being disposed below the lip and the second planar step being parallel to the bottom wall of the bottle, the flexible hollow body being defined by a bottle wall and a side wall that joins to the bottom wall, the flexible hollow body being configured such that when the flexible reusable liner is inserted into the hollow interior of the body, the side wall of the flexible hollow body seats flush against the side wall of the bottle.

* * * * *